US009146037B2

(12) United States Patent
Russell

(10) Patent No.: US 9,146,037 B2
(45) Date of Patent: Sep. 29, 2015

(54) CHIMNEY SWEEPING TOOL

(71) Applicant: Robert Russell, Norfolk (GB)

(72) Inventor: Robert Russell, Norfolk (GB)

( * ) Notice: Subject to any disclaimer, the term of this patent is extended or adjusted under 35 U.S.C. 154(b) by 57 days.

(21) Appl. No.: 13/868,617

(22) Filed: Apr. 23, 2013

(65) Prior Publication Data

US 2013/0283551 A1 Oct. 31, 2013

(30) Foreign Application Priority Data

Apr. 25, 2012 (EP) ..... 12165514

(51) Int. Cl.

| | |
|---|---|
| ***B08B 9/02*** | (2006.01) |
| ***F23J 3/02*** | (2006.01) |
| ***A46B 3/10*** | (2006.01) |
| *B08B 9/04* | (2006.01) |

(52) U.S. Cl.

CPC . *F23J 3/026* (2013.01); *A46B 3/10* (2013.01); *B08B 9/04* (2013.01); *F23J 3/02* (2013.01)

(58) Field of Classification Search

CPC ..... F23J 3/02; F23J 3/026; B08B 9/04
USPC ..... 15/3.5, 104.067, 104.068, 104.31, 197, 15/198

See application file for complete search history.

(56) References Cited

U.S. PATENT DOCUMENTS

| | | | | |
|---|---|---|---|---|
| 1,338,917 | A | 5/1920 | Hall | |
| 2,077,731 | A * | 4/1937 | Aaby | 15/104.068 |
| 2,654,905 | A * | 10/1953 | Davis, Jr | 15/198 |
| 3,305,888 | A * | 2/1967 | Soderberg | 15/179 |
| 4,247,964 | A * | 2/1981 | Lichliter et al. | 15/104.067 |
| 4,757,573 | A * | 7/1988 | Brophy | 15/104.069 |
| 4,768,255 | A * | 9/1988 | Wolfanger | 15/104.068 |
| 5,369,834 | A | 12/1994 | Groen et al. | |
| 5,608,941 | A * | 3/1997 | Kleinfeld | 15/179 |
| 5,745,948 | A * | 5/1998 | Lloyd et al. | 15/104.12 |
| 5,842,246 | A * | 12/1998 | Doyle | 15/104.068 |
| 6,688,800 | B2 | 2/2004 | Kresge | |
| 7,644,465 | B1 | 1/2010 | Bently | |
| 2009/0260180 | A1 | 10/2009 | Meredith et al. | |

FOREIGN PATENT DOCUMENTS

| | | |
|---|---|---|
| DE | 9214144.7 | 12/1992 |

* cited by examiner

*Primary Examiner* — Monica Carter
*Assistant Examiner* — Michael Jennings
(74) *Attorney, Agent, or Firm* — Donald S. Holland, Esq.; Holland & Bonzagni, P.C.

(57) ABSTRACT

Applicant has disclosed a rotating cleaning tool to clean chimneys, ductwork, venting and pipe. In the preferred embodiment, the tool includes a cylinder having: two curved channels in its bottom or proximal face; and two curved channels in a distal or upper surface. Separate strands of monofilament line and/or wire can be placed in the channels with the ends of the strands sticking out from both ends of the channels and the cylinder. An animal nest remover—a flat (or round) bar with upturned ends—can be mounted onto a central post extending from the cylinder. The remover can be used with or without the strands. Upon bolting the tool together, the strands and/or bar are held in place. By attaching the tool to a pole or rod, and rotating the rod after being inserted into the chimney, creosote and other unfriendly materials can be removed from chimneys.

8 Claims, 8 Drawing Sheets

CHIMNEY SWEEPING TOOL

FIELD OF INVENTION

This invention relates in general to tools used by chimney sweepers. More particularly, it relates to tools which can be attached to locking rods or poles to clean chimneys.

BACKGROUND OF INVENTION

While using a fireplace, a layer of creosote, ash and soot builds up on the inside of the chimney restricting the flow. Creosote is a byproduct of the incomplete combustion of wood. If not properly cleaned, the fireplace or chimney can catch fire.

Sometimes animals nest in chimneys, where chimneys have not been used for a while. For example, birds, vermin and insects make nests in chimneys/flues and ducting. Those should be removed to avoid unwanted guests in the home.

Typically, to properly clean a chimney one would use a professional chimney sweep. A chimney sweep uses a brush (or other tool) attached to a long pole, rod or chain that is inserted into the top of the chimney down through to the bottom of the chimney or, in the alternative, a pole or rod that is inserted from the bottom to the top. The brush is then used to scrape and remove the layers of creosote, ash and soot (or foreign materials) that has built up over time.

Years ago, chimney sweeps used rags attached to poles. That eventually progressed to various tools (e.g., wire brushes, scrapers or retrievers) attached to poles or rods.

Recently, releasable coupling devices have been utilized to attach various chimney sweeping tools to rods. Then the rods are rotated by hand-held power drills. One such coupling device is disclosed in U.S. Pat. No. 6,688,800 to David Wayne Kresge ("Kresge"), issued Feb. 10, 2004.

A problem arises where chimneys are not straight, such as the multi-angled chimneys in some old European homes. Those are difficult to clean, especially if the tool is rigid and cannot pass through all the angles.

Accordingly, it is a general object of the present invention to provide an improved chimney sweeping tool for cleaning both straight and angled chimneys.

It is another general object to provide an improved cleaning tool which can be used to clean chimneys, ductwork or flues.

It is a specific object to provide a tool, commensurate with the above-listed objects, which can be attached to a rod by a releasable coupling device.

SUMMARY OF INVENTION

Applicant has disclosed a rotating cleaning tool which uses multiple monofilament lines (preferred), wires or chains, to clean chimneys, as well as ductwork, venting and pipe. In the preferred embodiment, Applicant's tool comprises: a base containing a female connector of a push-button coupling device; a center post, with a threaded distal end, extending from the base; a cylinder, with a throughbore, mounted on the post; wherein the cylinder has similar curved channels in its top and bottom designed to house strands of monofilament line and/or wire, with the strand ends sticking out from the tool; a spacer, fit onto the distal end, after the cylinder; and a cap nut threaded onto the post to tighten the base, cylinder, and spacer together and keep the strands in place. Applicant prefers to connect his tool by the quick connect, coupling device disclosed in U.S. Pat. No. 6,688,800 to Kresge.

DETAILED DESCRIPTION OF PREFERRED EMBODIMENT(S)

Figure 1A:
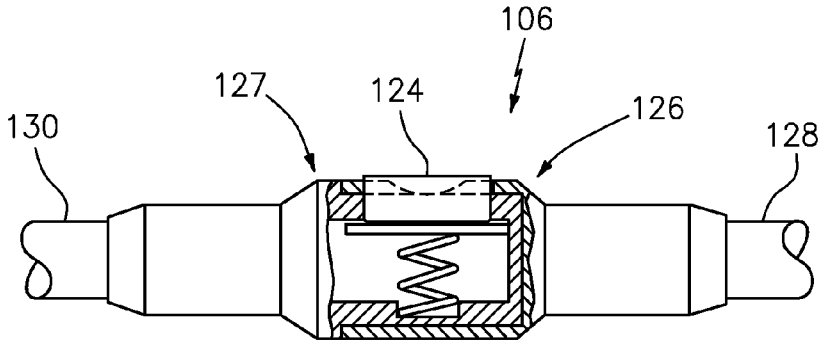
FIG. 1A (PRIOR ART)
FIGS. 1A, 1B, 1C, labeled Prior Art, depict a coupling device, with a push-button release, shown in the Kresge patent.

Referring to the drawings in detail, Applicant has disclosed an improved chimney and duct cleaning tool 100. In the preferred embodiment, Applicant's tool 100, when assembled, comprises: a base 102 containing a female connector 104 of a releasable coupling device 106; a threaded center post or rod 108, with a distal end 110, central to, integral with and extending from base 102; a cylinder (a.k.a. "holder") 112, with a non-threaded central throughbore, placed onto the post 108; the cylinder 112 has a pair of curved channels 113*a*, 113*b* extending through its proximal face or bottom 114 and virtually identical curved channels 113*c*, 113*d* in its distal face or top 115; wherein the channels 113*a*, 113*b*, 113*c*, 113*d* are designed to house infill material (i.e., discrete strands 116*a*, 116*b*, 116*c*, 116*d* of monofilament line and/or discrete strands 118*a*, 118*b*, 118*c*, 118*d* of wire), with both ends (e.g., 119*a*, 119*b*) of the strands sticking out from the tool 100; a spacer 120, fit onto the distal end 110, after the cylinder 112; and a cap nut 122 threaded onto the post 108 to tighten the base 102, cylinder 112 and spacer 120 together and to hold the strands (e.g., 116*a*, 116*b*, 116*c*, 116*d* or 118*a*, 118*b*, 118*c*, 118*d*) in place.

This chimney sweeping tool 100 is designed to be attached to locking poles or rods by, e.g., the releasable coupling device shown in U.S. Pat. No. 6,688,800 issued Feb. 10, 2004 to Kresge. Once locked, such a coupling device is useful as a spinning assembly of extension rods or poles connected to a variety of cleaning tools for chimneys and ductwork, such as brushes. The present Applicant hereby incorporates the Kresge patent herein by reference.

Figure 1B:
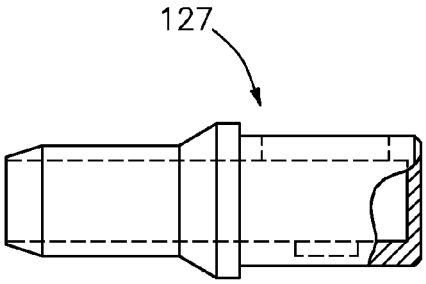
FIG. 1B (PRIOR ART)
Figure 1C:
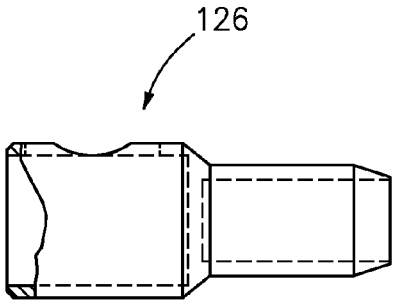
FIG. 1C (PRIOR ART)
Figure 3:
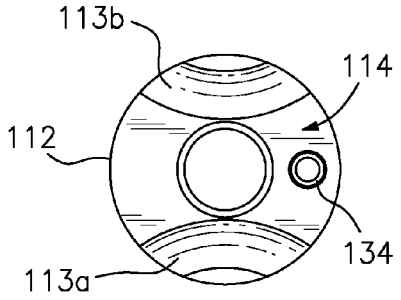
FIG. 3 is a plan view of the bottom of a cylinder shown in FIG. 2.
Figure 4:
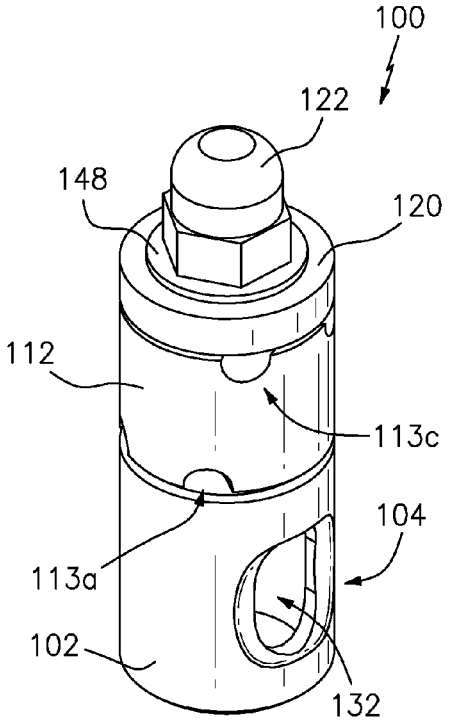
FIG. 4 shows the FIG. 2 tool assembled without any chains or strands of infill material.
Figure 5:
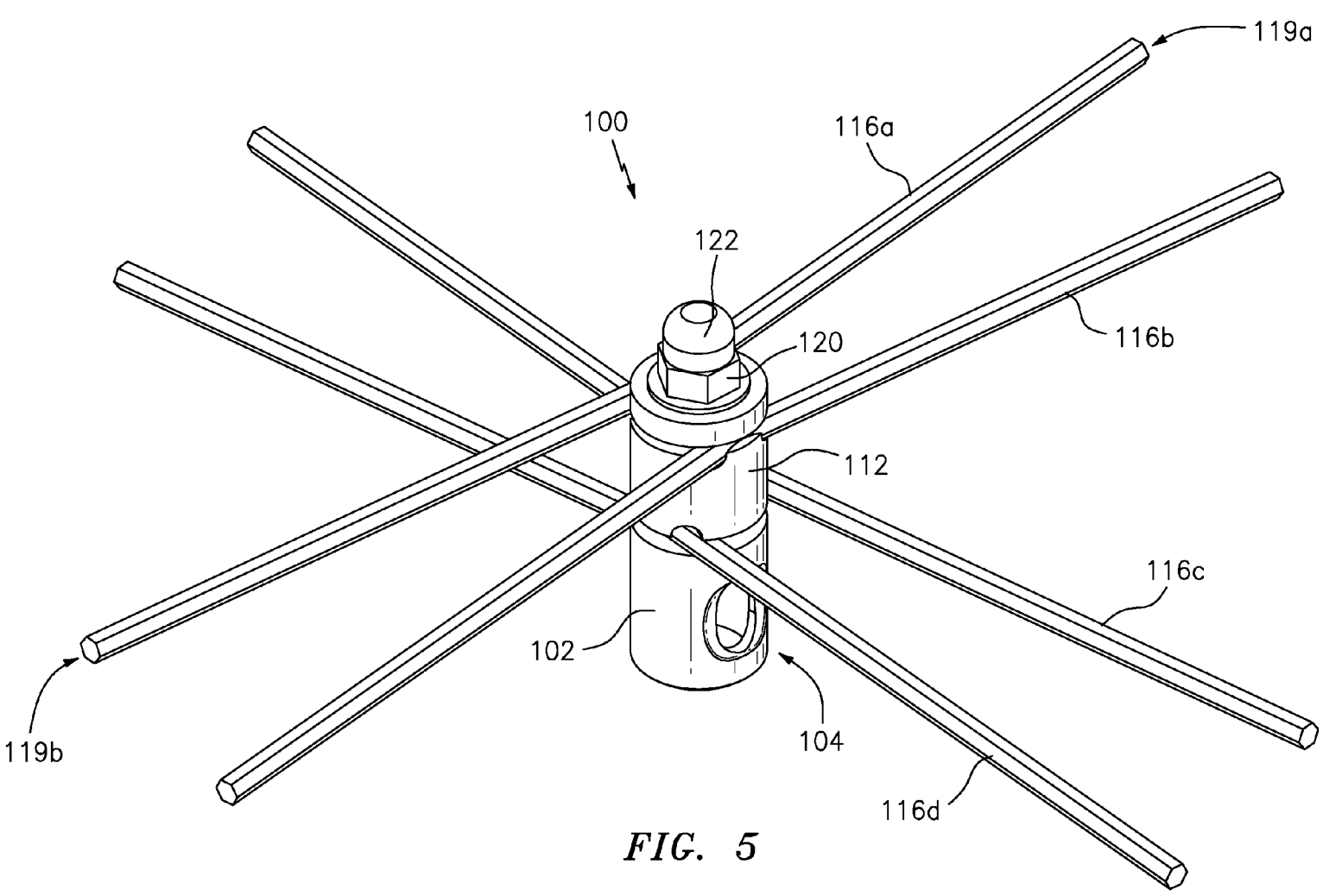
FIG. 5 shows the FIG. 2 tool assembled with discrete strands of monofilament line extending from the tool.

Applicant's FIGS. 1A, 1B, 1C depict the Kresge connector; these drawings correspond to FIGS. 1, 3, 5 in Kresge but with Applicant's reference numbers. Kresge discloses an easy connect/disconnect coupling device marketed by A.W. Perkins Co. of Rutland, Vt. USA under the trademark, "ButtonLok."

A.W. Perkins' ButtonLok™ coupler 106, as disclosed in Kresge, utilizes a spring-loaded plunger 124 to lock male and female connectors 126, 127 (i.e., on opposing ends of two rods 128, 130) together. The plunger 124 also acts as a push button release to unlock the connectors 126, 127, so they can be pulled apart.

The assembled tool 100 may be hand worked or, for greater efficiency in the right circumstances, rotated by use of a hand drill (not shown) connected to the assembled rod 128 and tool 100 by a drill adapter (not shown) to create a spinning assembly. This is often useful for the cleaning of a large variety of ductwork, chimneys, venting and pipes. The particular designs of the male and female connectors are given in Kresge and are unchanged by the tool described here which attaches to the working end of the rod assembly.

The ButtonLok™ couplers sold are of one of two designs depending on the size of the rods and brushes connected. A small size coupler is used for dryer vent and pellet vent cleaning rods and tools. The larger coupler is used for chimney, ventilation and air duct cleaning applications, where the torque developed is much higher and the design needs to be more robust.

Turning to particulars of Applicants' tool 100, a hole 132 is located in the female connector 104, as in the Kresge patent. This hole 132 is designed to accept the push-button plunger 124 of Kresge's coupler (i.e., ButtonLok™) 106. The perimeter surrounding hole 132 is stepped down, towards the hole, to accommodate a user's thumb.

Cylinder 112 is preferably made of steel, as are the rest of the tool parts. The cylinder contains a locating pin 134 on its proximal face. Pin 134 is designed to slip into a hole 136 in a top face 138 of base 102. Similarly, spacer 120 has a pin (not shown) designed to slip into a hole 140 in a distal face 115 of cylinder 112.

In the preferred embodiment, cylinder 112 is basically a right cylinder. Other shapes, instead of a right cylinder 112, can also suffice. Consequently, the cylinder can be thought of generically as a "strand holding attachment" or "strand holder".

Figure 2:
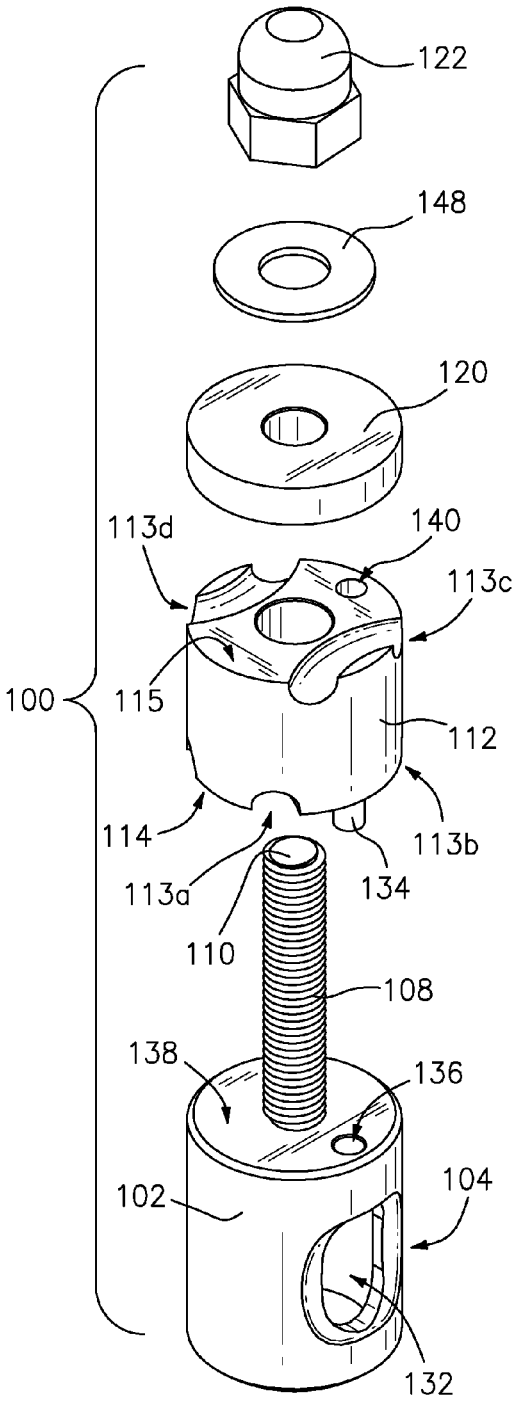
FIG. 2 depicts an exploded view of a preferred embodiment of Applicant's "Chimney Sweeping Tool"

As best shown in FIGS. 2 and 3, the channels (slots) 113*a*, 113*b*, 113*c*, 113*d* are curved and semicircular in cross-section. Since the channels extend across the proximal and distal faces 113, 115 of cylinder 112, the ends of channels 113*a*, 113*b*, 113*c*, 113*d* exit the "side" around cylinder 112. The channels 113*a*, 113*b* open towards base 102, while the channels 113*c*, 113*d* open towards spacer 120, when the tool 100 is assembled. (Other suitable shapes could be used instead.)

Figure 6:
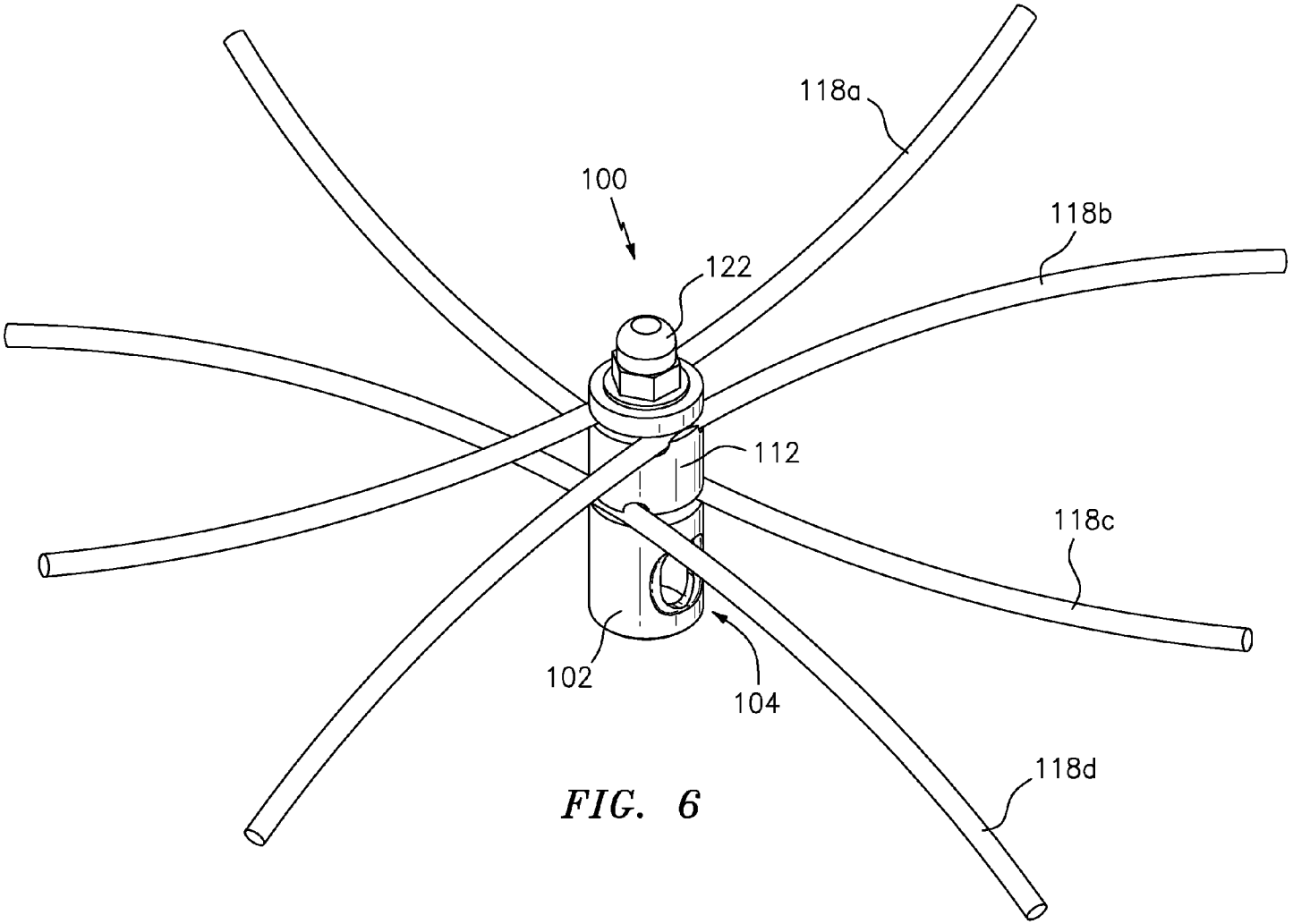
FIG. 6 shows the FIG. 2 tool assembled with discrete strands of monofilament line and wire extending from the tool.

Discrete strands (e.g., 116*a*, 116*b*, 116*c*, 116*d*) of the monofilament line (see FIG. 5) and/or discrete strands (e.g., 118*a*, 118*b*, 118*c*, 118*d*) of wire (see FIG. 6) can be fed through the channels 113*a*, 113*b*, 113*c*, 113*d* with opposite ends (e.g., see 119*a*, 119*b* in FIG. 5) of the strands sticking out of the channels 113*a*, 113*b*, 113*c*, 113*d* and cylinder 112, before the tool 100 is tightened down.

Figure 7:
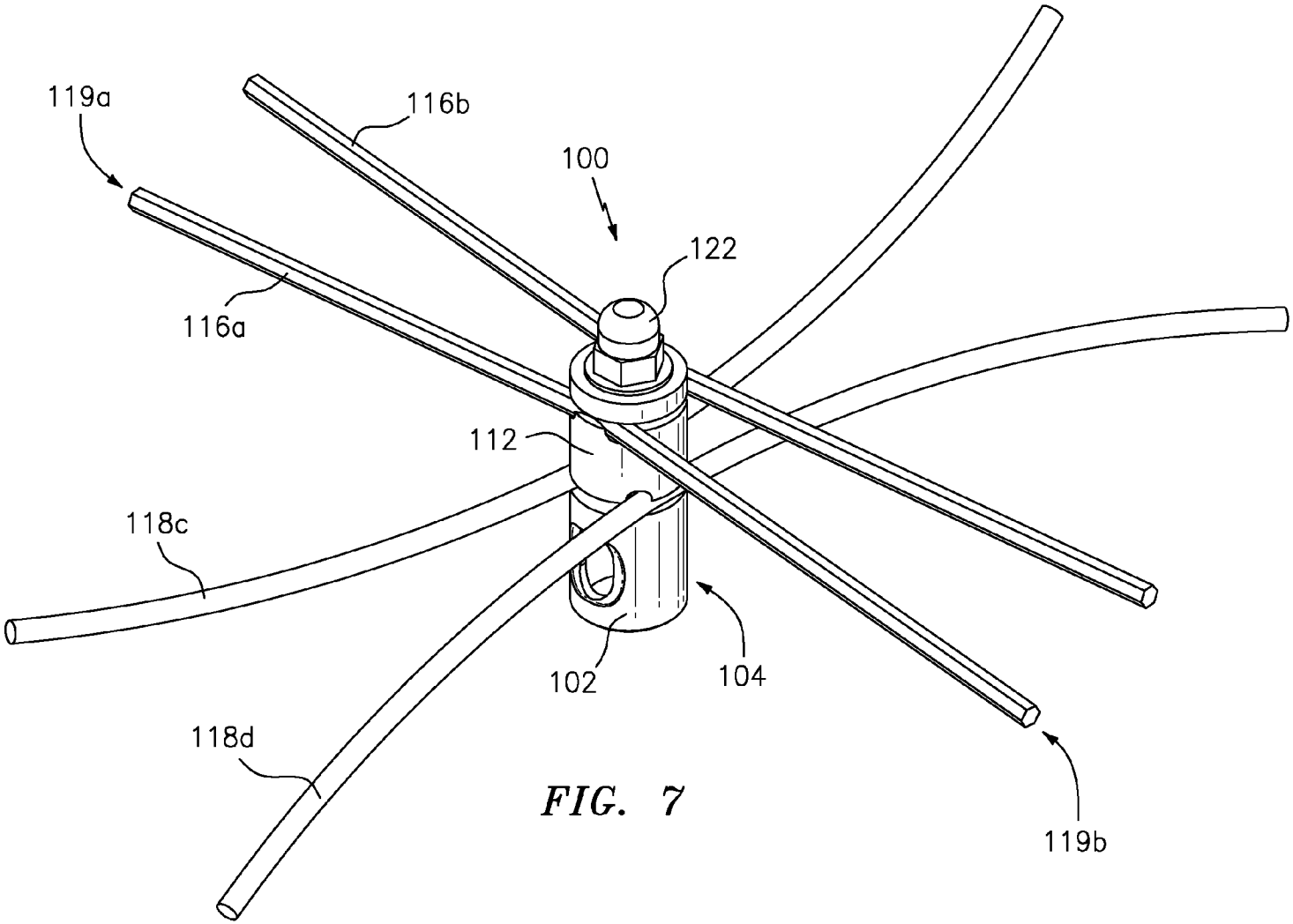
FIG. 7 shows the FIG. 2 tool assembled with discrete strands of wire extending from the tool.

FIG. 7 shows strands of line and wire (116*a*, 116*b*, 118*c*, 118*d*) being used.

Upon tightening the nut 122 the strands of line and/or wire are gripped by: the channels 113*a*, 113*b*, in which strands are inserted, and the base 102; and the channels 113*c*, 113*d*, in which strands are inserted, by the spacer 120.

The channels (slots) 113*a*, 113*b*, 113*c*, 113*d* are cut into the metal using, for example, a ball-end mill. The depth of cut to the bottom of each slot is greater than half the diameter of the ball-end mill. Each slot is precisely sized to accommodate the line or wire of the appropriate size. Furthermore these channels are cut along a swept radius of size sufficient to grip infill material (e.g., 116*a*, 116*b*, 118*c*, 118*d*) securely.

As used herein, the term "swept radius" gives the clearance required around the primary axis (i.e., the longitudinal axis of tool 100) to avoid clashes when the primary axis is rotated through 360°.

One object of these curved channels 113*a*, 113*b*, 113*c*, 113*d* is the easy and secure fixing of the infill material within the cylinder 112. This infill material resists bending and is elastic in usual handling.

By bending the line (e.g., 116*a* or 116*b*) or wire (e.g., 118*a* or 118*b*) to the swept radius of a slot (e.g., 113*c* or 113*d*) the line or wire fits right into that slot. When the line or wire is released, it springs back such that it is held by the slot where one "side" makes contact with the edge at both exit points of the slot (e.g., 113*c* or 113*d*). The line (e.g., 116*a* or 116*b*) or wire (e.g., 118*a* or 118*b*) is pressed from its opposite side by the inner surface of the swept radius.

Additional tool parts shown are: a standard washer 148 (thinner than spacer 120), which some may choose to omit; and a nylon insert locknut (not shown), instead of the cap nut 122.

The line (e.g., 116*a*, 116*b*, 116*c*, 116*d*) or wire (e.g., 118*a*, 118*b*, 118*c*, 118*d*) will wear over time. Re-stringing is simple using this design.

Different sizes of channels 113*a*, 113*b*, 113*c*, 113*d* could be made so that smaller or larger line or wire could be used in the second part and changed quickly for different applications without needing to have another complete tool.

Applicant envisions the spacer 120 and/or washer 148 can be easily replaced with interchangeable tools useful to the chimney sweep or duct cleaning professional.

Figure 8:
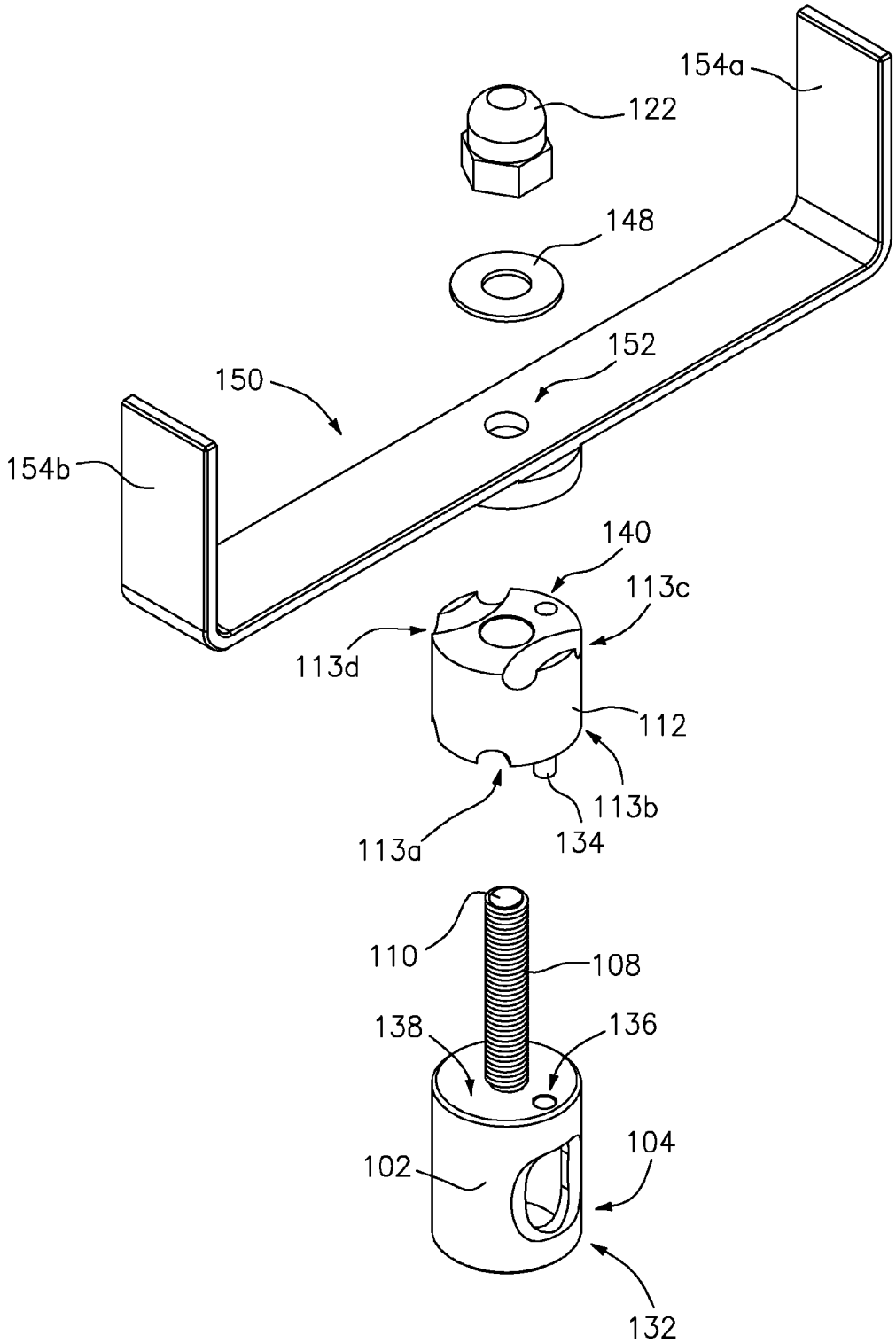
FIG. 8 is another exploded view of Applicant's "Chimney Sweeping Tool", which includes an extra accessory—an animal nest remover.
Figure 9:
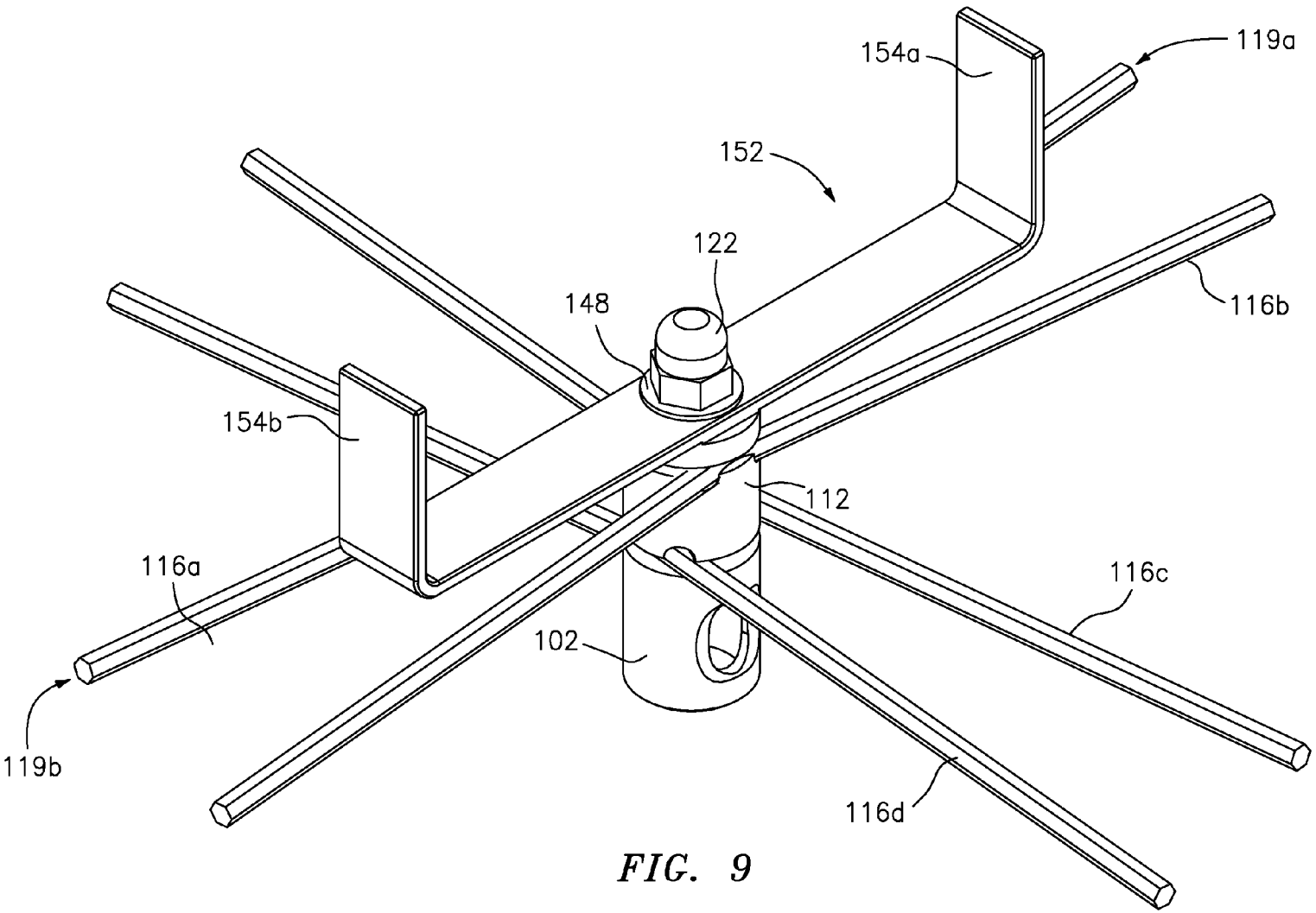
FIG. 9 shows the FIG. 8 tool components assembled, with discrete strands of monofilament line extending from the tool.

FIGS. 8-9 show another attachment for Applicant's tool 100: a "bird nest remover" 150. The bird nest remover 150 has: a central throughbore 152; and upturned ends 154*a*, 154*b*. This attachment 150 could be made in flat bar stock (or round or square stock). The thickness of the attachment 150, where it connects to the post 108 is the same as the spacer 120 in the first embodiment.

FIGS. 8-9 illustrate the bar stock (150) as being a straight flat bar with upturned ends (154*a*, 154*b*). The upturned ends, as illustrated, are substantially perpendicular to the mid-section of the flat bar portion. Note that the straight flat bar, when the tool (100) is assembled, is substantially parallel to the top of cylinder (112).

When used as an animal nest remover 150, the cylinder 112 may be left on the tool 100, filled with line 116*a*, 116*b*, 116*c*, 116*d* or wire 118*a*, 118*b*, 118*c*, 118*d*, as the cleaning action is helpful for the expected work removing bird nests and associated debris. The line or wire may be removed if cleaning action is not desired.

Figure 10:
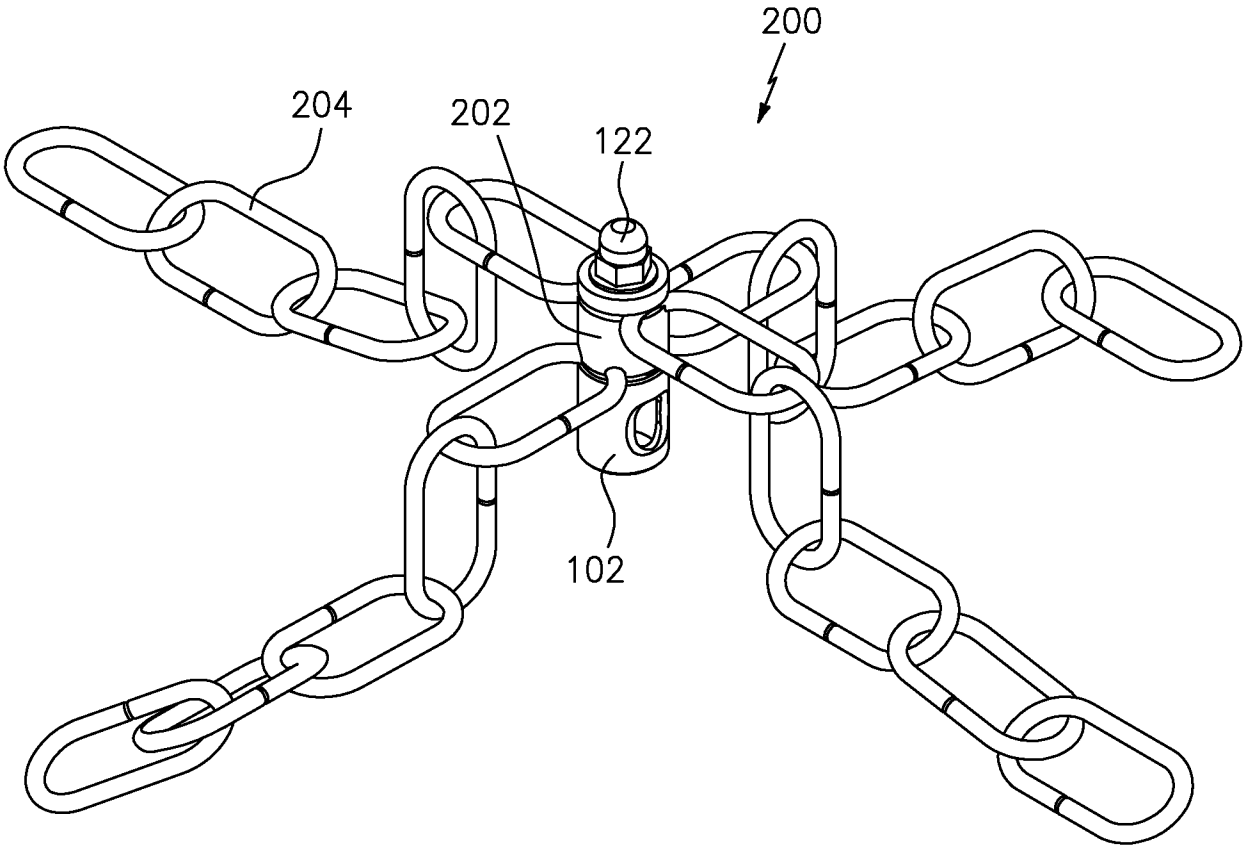
FIG. 10 shows an alternate embodiment of the FIG. 2 tool with chains instead of strands of wire or monofilament line.

FIG. 10 shows an alternate embodiment 200. In this embodiment, the cylinder 112 is replaced with a chain holding attachment 202. The chain holding attachment 202 has channels (not shown) similar to channels 113*c*, 113*d* but deeper. (Alternatively, the original cylinder 112 can still be used if channels 113*c*, 113*d* are deep enough to house a desired thickness of chains 204.) Chains 204 are particularly useful on harder chimney and vent deposits such as creosote and tar like materials. The chains 204 could be arranged as shown with two (or more) chains between the chain attachment 202 and the base 102 and two more chains between the chain attachment 202 and spacer 120.

Alternatively the chains 204 could be arranged in any other configuration about the axis of rotation with an equal weight distribution of chain materials to keep a good balance on the tool when spinning.

In the third embodiment 200, there is a pin (not shown) and a matching hole (not shown), as in the preferred embodiment

100, between the chain attachment 202 and the cylindrical base 102. This pin is located radially from the center post 108 at sufficient distance to secure the parts together. The chain itself is securely held within the channels formed to match the chain's profile. In this embodiment a ball end mill sized to fit the chain was used.

It should be understood by those skilled in the art that obvious modifications can be made to Applicant's preferred apparatus or related method without departing from the spirit or scope of the invention. For example, the female connector 106 in tool 100 could be the male connector 126 instead. Accordingly, reference should be made primarily to the following claims rather than the foregoing description to better understand the scope of the present invention.

I claim:

1. A chimney and duct cleaning tool comprising:

a. a base wherein the post has a distal end beyond the base containing a female connector of a releasable coupling device;

b. a threaded center post integral with and extending from the base;

c. a cylinder, with a central throughbore, mounted onto the post;

i. wherein the cylinder has a pair of curved channels, extending along and through a proximal surface of the cylinder, designed to house discrete strands of infill material with the strands extending beyond the cylinder; and ii. wherein each of the channels is cut along a swept radius to avoid clashes of the discrete strands of infill material when the cleaning tool is rotated during cleaning;

d. a spacer, fit onto the distal end, after the cylinder;

e. a cap nut threaded onto the post to tighten the base, cylinder and spacer together and to hold the strands in place between the channels and the base; and f. an animal nest remover, mounted on the post, between the cylinder and cap nut, wherein:

i. the animal nest remover is a straight bar with upturned ends; and ii. the bar has a central throughbore through which the post extends.

2. The tool of claim 1 wherein the strands of infill material comprise monofilament line.

3. The tool of claim 1 wherein the strands of infill material comprises wire instead of monofilament line.

4. A chimney and duct cleaning tool comprising:

a. a base comprising a connector of a releasable coupling device;

b. a post integral with, central to, and extending from the base, wherein the post has a distal end beyond the base;

c. a strand holder, mounted onto the post, wherein the holder has channels extending along and through a bottom of the holder;

d. discrete strands of infill material, inserted in the channels, with the strands extending beyond the holder;

e. a nut, threaded onto the threaded distal end, to tighten the base and holder together and to hold the strands in place between the channels and the base; and f. an animal nest remover, mounted on the post, between the strand holder and cap nut, wherein:

i. the animal nest remover is a straight flat bar with upturned ends extending beyond the holder; and ii. the straight flat bar has a central throughbore through which the post extends.

5. The tool of claim 4 wherein the upturned ends are substantially perpendicular to a remainder of the flat bar.

6. The tool of claim 4 wherein the strands of infill material comprises monofilament line.

7. The tool of claim 4 wherein the strands of infill material comprises wire instead of strands of monofilament line.

8. A chimney and duct cleaning tool comprising:

a. a base comprising a connector of a releasable coupling device;

b. a threaded post, central to, and extending from the base;

c. a cylinder, with a central throughbore, mounted onto the post;

d. an animal nest remover mounted, atop the cylinder, on the post;

e. wherein the animal nest remover comprises:

i. a straight flat bar with upturned ends extending beyond the base;

ii. a central throughbore, in the straight flat bar, through which the post extends;

iii. the straight flat bar is substantially parallel to a top of the cylinder; and f. a nut, threaded onto the post, to tighten the base and cylinder together and to secure the animal nest remover between the cylinder and nut.

* * * * *